United States Patent [19]

Süling et al.

[11] 3,936,556

[45] Feb. 3, 1976

[54] MARKING OF ARTICLES

[75] Inventors: Carlhans Süling, Odenthal-Hahnenberg; Hans Theidel; Hellmut Striegler, both of Leverkusen; Wolfram von Langenthal, Pulheim, all of Germany

[73] Assignee: Bayer Aktiengesellschaft, Germany

[22] Filed: Feb. 13, 1974

[21] Appl. No.: 442,177

[30] Foreign Application Priority Data

Feb. 16, 1973 Germany ..... 2307592

[52] U.S. Cl. ..... 428/195; 8/46; 8/DIG. 7; 427/8; 427/256; 427/258; 427/288; 428/262

[51] Int. Cl.[2] ..... B41M 3/14

[58] Field of Search ..... 117/37 R, 38, 1; 8/DIG. 7, 8/46; 427/8, 256, 258, 261, 288, 399; 428/195, 262, 375, 396

[56] References Cited

UNITED STATES PATENTS 3,177,214 4/1965 Sulzer et al. ..... 260/249

FOREIGN PATENTS OR APPLICATIONS 1,133,689 11/1968 United Kingdom ..... 8/DIG. 7

1,174,988 7/1964 Germany ..... 8/DIG. 7

*Primary Examiner*—Thomas J. Herbert, Jr.

*Assistant Examiner*—Bruce H. Hess

*Attorney, Agent, or Firm*—Connolly and Hutz

[57] ABSTRACT

A process for identifying manufactured articles in which a marking agent such as a homo- or copolymer of polymerizable ethylenically unsatured monomers is applied to the articles. Said homo- or copolymer contains at least one group which can be split off to form a low molecular weight compound such as an amine or phenol, which can be converted into dyes, said dyes being used to identify the manufactured articles.

9 Claims, 1 Drawing Figure

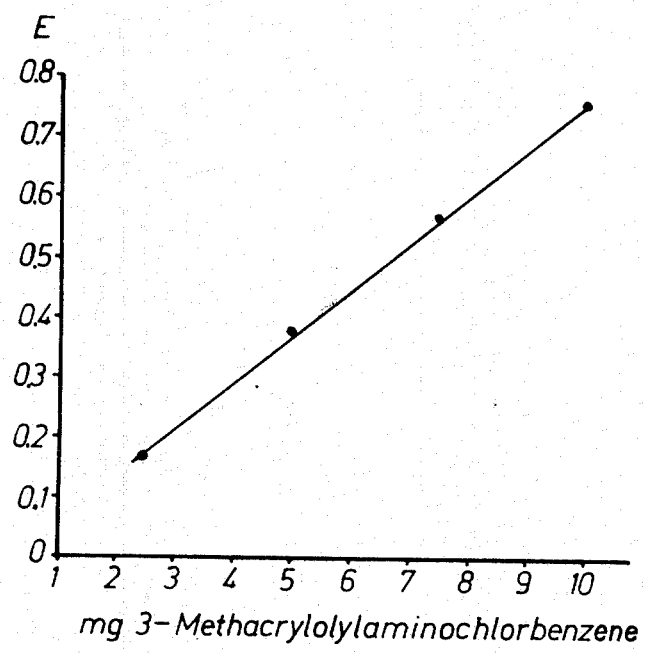
E
0.8
0.7
0.6
0.5
0.4
0.3
0.2
0.1
0
1
2
3
4
5
6
7
8
9
10
mg 3-Methacrylolylaminochlorbenzene

MARKING OF ARTICLES

This invention relates to the marking of articles by means of special polymers and identification of the marked articles by a color reaction.

It is known that manufactured articles can be marked by incorporating low molecular weight organic compounds or rare inorganic compounds into them. A disadvantage of the known process is that the marking agents may be removed in use.

Textile articles can also be marked with special fibers which may be recognizable, for example, by the special form of their cross-section. The disadvantage of this method of marking is that the textile article which is to be identified can only be made of certain fibers or fiber mixtures. Moreover, the analyses required are time-consuming and therefore expensive and the uncertainty factor is also relatively high.

Thus, there is a demand for a simple and reliable method of indentifying manufactured articles.

It was therefore an object of this invention to find a method for marking manufactured articles which would be simple in its application, sensitive and reliable and which would also be very variable.

The problem was solved by using as marking agents high molecular weight compounds containing functional groups which after being split off from the polymer molecule form low molecular weight compounds which can be converted into dyes. The monomer used for marking has the basic formula I $$P - F \qquad (I)$$

in which P denotes a reactive group which can be converted into homopolymers or copolymers by a polymerising reaction. The polymers may be prepared by polyaddition reactions or polycondensation reactions but preferably by polymerisation reactions of the kind entered into by compounds which contain olefinic double bonds.

F denotes a group which when split off from the polymer is a low molecular weight compound which can be converted into dyes.

This low molecular weight compound is preferably converted into a characteristic dye such as a dye of the anthraquinone, triphenylmethane, cyanine, fluorescein or preferably azo dye series, by known processes. Removal of the group F by a cleaving reaction and the formation of the low molecular weight compound can be carried out by oxidation, reduction, pyrolysis or hydrolysis (saponification).

This invention relates to a process for identifying manufactured articles by means of marking agents, characterized in that the marking agents used are high molecular weight compounds containing groups which when split from the compounds form low molecular weight compounds which are convertible into dyes. Said dyes being used for identifying the articles.

The process according to the invention represents a method of identification and quality control of manufactured articles which is easy to perform, reliable and reproducible because the process according to the invention gives rise to definite, preferably low molecular weight dyes which can be analysed qualitatively and quantitatively by various known methods even in very small quantities. Another advantage is that the component which serves as the marker is chemically incorporated into a polymer so that the marking agent cannot be removed from the polymer by physical means (such as treatment with solvents or detergents). If it is desired that the properties of the polymers should remain practically unchanged, the marking agents need only be incorporated in very small quantities in the polymer.

Manufactured articles are understood in this application to means bodies produced by ordinary casting, centrifugal casting or injection moulding, coatings, self-supporting films, threads, fibers, woven structures, non-woven fleeces or foils. They may be completely (in the case of homopolymers or copolymers) or partly composed of the marked polymers. The term "partly" means that they are composed of physical mixtures of marking and non-marking polymers.

The manufactured articles are preferably textile webs such as woven fabrics, fleeces, knitted fabrics or paper webs equipped with marking polymers but the textile webs do not themselves contain marking polymers.

The term fleeces is used to cover any of the usual fiber fleeces, e.g. long pile fleeces manufactured by the wet process on paper machines or cross-laid fleeces produced on carding machines or random fiber fleeces and felts made of wool or synthetic fibers.

The fibers used for producing the fleeces may be natural cellulose fibers such as cotton, jute, ramie or linen or regenerated cellulose such as rayon, cuprammonium cellulose fiber, viscose cellulose, fibers of cellulose esters such as cellulose acetate, natural fibers such as silk or wool and regenerated fibers made of protein degradation products, fibers of polyesters such as polyethylene glycol terephthalate, fibers based on condensation products of saturated aliphatic diamines and dicarboxylic acids and polymerisation products of suitable cyclic lactams, vinyl resin fibers e.g. those obtained from a copolymer of vinyl chloride and vinyl acetate or of vinyl chloride and up to 40 % of acrylonitrile, polypropylene, acrylonitrile polymers and acrylonitrile copolymers which contain more than 40 % of bound acrylonitrile, further polyurethanes, polyvinyl alcohol, at least partly saponified ethylene/vinyl acetate copolymers or inorganic fibers, for example glass or asbestos fibers and metal fibers. Any mixtures of the above mentioned types of fibers may, of course, also be used.

In the phrase "equipped woven fabrics, fleeces, knitted fabrics or paper", the term "equipped" means impregnated, solidified, coated, bonded or printed.

Application of the marking polymers to textile webs such as woven or knitted fabrics or fleeces or paper may be carried out by known methods, for example by immersion spraying, knife coating, calendering, spread coating, etc. The marking polymers also may be applied in the form of powders or solutions in organic solvents or water or as dispersions, preferably aqueous dispersions. If desired, the marking polymers may be used as mixtures with other polymers.

The usual auxiliary agents employed in the textile and paper industry may be added to the aqueous dispersions of the marking polymers, e.g. soluble and insoluble dyes, inorganic and organic pigments, optical brightening agents, surface active substances such as emulsifiers, wetting agents and foaming agents, thickeners (alginates and cellulose or starch ethers or esters), fillers such as kaolin, bentonite, stabilizers such as casein, polyvinyl alcohol, ammonium salts of polyacrylic acid, high grade finishing products such as reactive resins (urea formaldehyde resins), aminoplast and phenoplast precondensates, hardenable epoxy condensates, insecticides, fungicides, bactericides and if desired age resistors and bonding agents.

If the marking polymers are prepared by polycondensation or polyaddition reactions, they for instance contain etherified or esterified units of compounds such as N,N-dihydroxyethylaniline, N,N-dihydroxyethyl-m-toluidine or N,N-dihydroxyethyl-m-anisidine or N,N-dihydroxyethyl-o-anisidine as marking components. The color producing component is obtained by degradation (saponification) and can be converted into characteristic azo dyes, for example by coupling with nitrophenyl diazonium chloride.

The marking polymers are preferably polymers which are prepared by radical polymerisation of at least one monomer of formula II either alone or mixed with at least one other coplymerised monomer by the known methods of solvent-free, solution, emulsion or suspension polymerisation. The copolymers obtained may be arranged at random, grafted or block copolymers, depending on the polymerisation conditions employed. Random copolymers are preferred.

In formula II

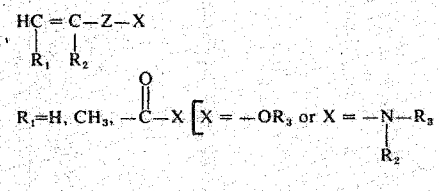

II and at least one group X may be converted by hydrolysis into a diazotisable amine or into an amine or phenol which can be coupled with diazonium salts];

$R_2$ = H or $C_1$–$C_{12}$ alkyl, preferably H— or $C_1$–$C_4$-alkyl, particularly H— or —$CH_3$;

$R_3$ = an aromatic group which may be interrupted by hetero atoms (S, N or O) or by heteroatomic groups [—$SO_2$—, —NH— or —$SO_2$—NH—$SO_2$—] such as a phenyl, naphthyl, diphenyl or anthraquinonyl group any of which may be substituted by $C_1$–$C_4$-alkyl, $C_1$–$C_4$-alkoxy or halogen, or a heterocyclic group which may form part of an azo compound after diazotisation and coupling or after coupling alone;

in which $R_4$ and $R_5$ (which may be identical or different) represent alkylene groups containing 1 to 4 carbon atoms;

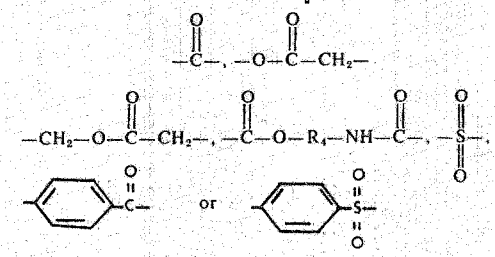

with the restriction that when

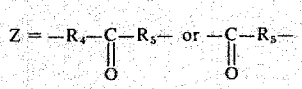

then $R_1$ is always

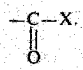

The marking polymers preferably contain polymerised units of monomers of formula III

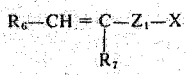

III in which $R_6$ = H, —COOH;

$R_7$ = H, —$CH_3$;

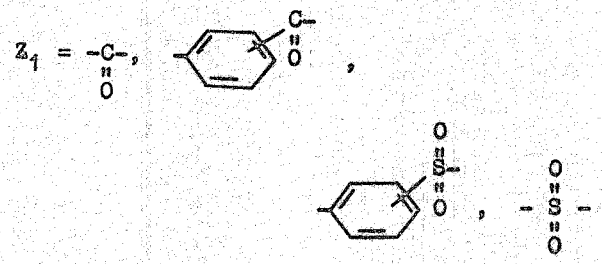

preferably

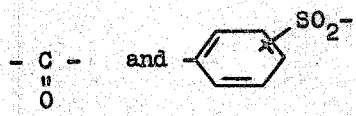

X has the same meaning as in formula II and preferably denotes

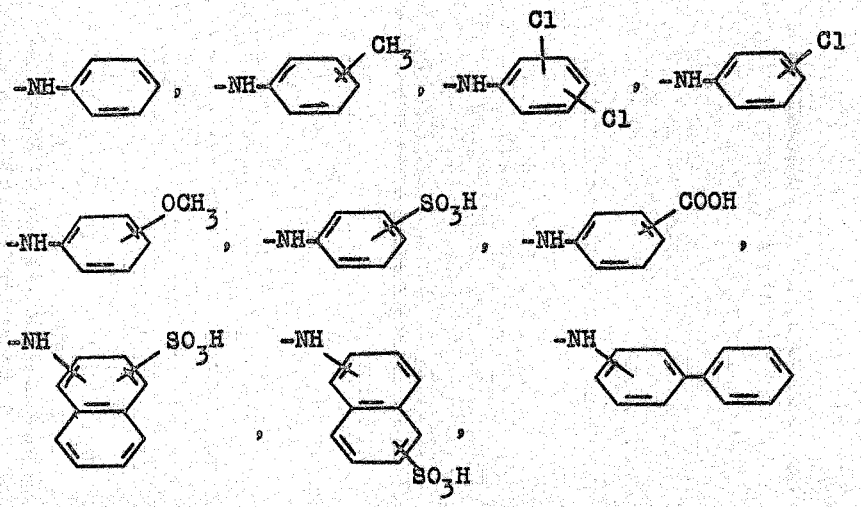

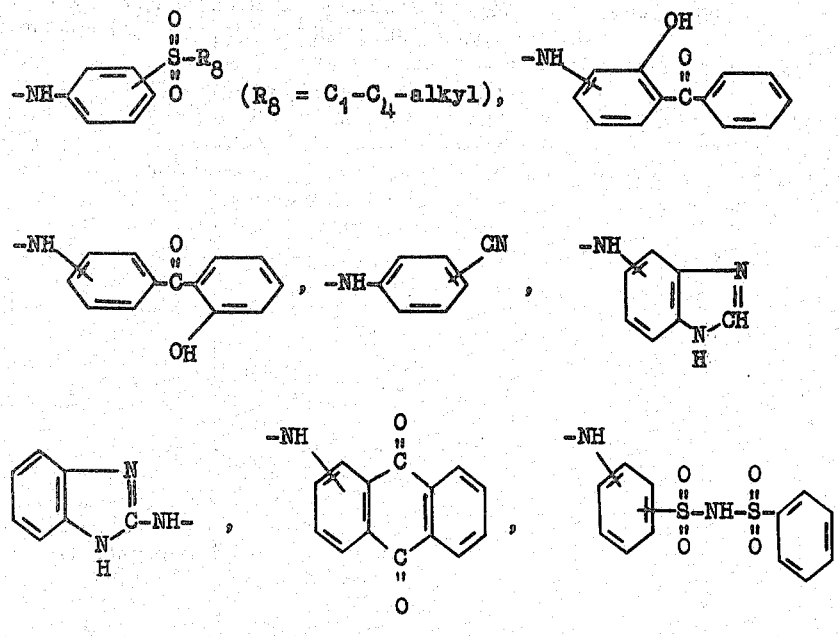

Particularly good results are obtained if the marking polymers contain polymerised units of compounds such as methacrylic acid anilide, acrylic acid anilide, maleic acid half anilide, 3-acryloyl-aminobenzenesulphonamide, 3-methacryloyl-aminobenzene sulphonamide, 2-maleinylaminobenzene sulphonamide, 4-acryloylaminobenzene sulphonamide, 4-methacryloylbenzene sulphonic acid amide, 4-maleinylbenzene-sulphonic acid amide, 3-acryloylaminotoluene, 3-methacryloylaminotoluene and the corresponding maleic acid semiamide, fumaric acid derivatives such as fumaric acid diphenylamide or fumaric acid diphenyl ester, acrylic acid-2,5-dichlorophenylamide, methacrylic acid-2,5-dichlorophenylamide and the corresponding maleic acid semiamide, acrylic and methacrylic acid-3-chlorophenylamide, acrylic and methacrylic acid-4-ethylsulphonylphenylamide, acrylic and methacrylic acid-3-methoxyphenylamide, 3-acryloylamino and 3-methacryloylamino benzimidazole and 3-methacryloylaminobenzene-sulphonic acid-1-benzene sulphonyl-amide.

Preparation of the marking monomers according to formulae II and III can be carried out by known methods of reacting acrylating agents such as olefinically unsaturated carboxylic or sulphonic acid chlorides (e.g. (meth)acrylic acid chloride) or their anhydrides (e.g. maleic acid anhydride) with aromatic or heterocyclic amines (primary or secondary) or with phenols.

Acylation may be carried out at temperatures of −10°C to 50°C, if desired in organic solvents such as acetonitrile, acetone, dioxane, chloroform or pyridine. It is frequently advantageous to carry out acylation by the addition of organic or inorganic bases. Suitable organic bases are e.g. pyridine, alkylpyridines or trialkylamines such as triethylamine.

A preferred method of preparing the monomers consists of reacting acid chlorides with primary or secondary aromatic amines in an aqueous medium at pH values of around 7, optionally with the addition of bases such as NaOH, $Na_2CO_3$, $NaHCO_3$ or pyridine.

The marking monomers mentioned above can be converted into homopolymers with molecular weights of >2000 to <2,000,000 by known methods of bulk polymerisation, emulsion polymerisation or polymerisation in suspension with the aid of initiators which form free radicals such as peroxides, azo compounds or redox catalysts at temperatures of −10° to 150°C. The homopolymers obtained (0.04 to 10.0 % by weight, preferably 0.06 to 10 % by weight) may be mixed with up to 99.96 % by weight, preferably 99.94 to 90.0 % by weight of other polymers suitable for finishing textile webs, and used in this way for marking textile webs in accordance with the invention. The other polymers used may be, for example, the following: Polyolefines such as polyethylene, polydiolefines such as polybutadiene, aromatic polyvinyl compounds such as polystyrene, poly(meth)acrylates or the copolymers of these olefinic unsaturated monomers, futher polyesters such as partly saponified polyvinyl acetates, condensation products of polybasic carboxylic acids and polyhydric alcohols, polyamides such as poly(meth)acrylamides or polyamides based on aminocarboxylic acids or lactams or based on condensation products of dicarboxylic acids and diamines or polyamines, polyvinyl chloride, polyurethanes, polyapoxides, phenoplasts, aminoplasts, polyvinyl alcohol, starch, starch or cellulose derivatives, casein, etc..

The following are examples of suitable monomers which may be copolymerised with the above mentioned monomers of formula II or III: Styrene, chlorostyrenes, vinylacetate, vinyl chloride, vinylidene chloride, ethylene, propylene, isobutylene, alkylvinylethers containing 1 to 4 carbon atoms in the alkyl group such as butyl vinyl ether, acrylonitrile, methacrylonitrile, acrylamide, methacrylamide, acrylic acid, methacrylic acid, methacrylic acid methylamide, maleic acid anhydride, maleic acid semiesters containing 1 to 6 carbon atoms in the alcohol component, (meth)acrylic acid esters containing 1 to 12 carbon atoms in the alcohol component such as methyl acrylate, methyl methacrylate, ethyl acrylate ethylmethacrylate, propyl acrylate, propylmethacrylate, butyl acrylate, butyl methacrylate, ethyl hexylacrylate, cyclohexylmethacrylate, hydroxyalkyl esters of (meth)acrylic acid which contain 2 to 4 carbon atoms in the alkyl group, such as hydroxyethyl acrylate, hydroxyethylmethacrylate, hydroxypropylacrylate and hydroxypropylmethacrylate, butadiene, isoprene, chloroprene or mixtures of the above mentioned monomers.

The following are preferably used: Styrene, methyl acrylate, ethyl acrylate, propyl acrylate, butyl acrylate, 2-ethylhexylacrylate, 2-hydroxyethylacrylate, 2-hydroxypropylacrylate, 3-hydroxypropylacrylate, 4-hydroxybutylacrylate, and the corresponding above mentioned esters of methacrylic acid; vinyl acetate, acrylonitrile, vinyl chloride, acrylic acid, methacrylic acid or mixtures of the above mentioned monomers.

The monomers mentioned below are preferably used in quantities of 1–40 % by weight, based on the total quantity of monomers, in ternary mixtures: Ethylene, propylene, isobutylene, vinyl chloride, vinylidene chloride, (meth)-acrylonitrile and chlorostyrenes. Binary systems of the above mentioned monomers with marking monomers are less suitable.

The marking monomers may be copolymerised in quantities of 0.05 to 20 % by weight, preferably 3 to 8 % by weight, with at least one other of the above mentioned monomers used in quantities of 99.95 to 80 % by weight, preferably 92 to 97 % by weight. The products obtained are preferably random copolymers with average molecular weights of between 75,000 and slightly below 1,000,000. The marking monomers and other monomers are in most cases incorporated in the copolymer at the monomer feed rates.

In the case of monomers which have differing reactivities, however, it may be advisable (e.g. in the case of olefines) to use more (e.g. a multiple) of the more slowly polymerising monomers in order to obtain the given percentage composition.

Copolymerisation is carried out by the known methods of bulk, solution or dispersion polymerisation. In some cases emulsion polymerisation is preferred. It is advantageously carried out in aqueous dispersions at temperatures of 10° to 80°C in the presence of conventional polymerisation catalysts with form free radicals, polymers, preferably random copolymers, being obtained with solids contents of about 20 to 50% by weight.

The above mentioned marking copolymers may be used in admixtures with other, unmarked copolymers, namely mixtures consisting of 3–20 % by weight, preferably 5 to 10 % by weight of the marking polymers and 97 to 80 % by weight, preferably 95 to 90 % by weight of the other, unmarked copolymers. The unmarked copolymers may be prepared from the same nonmarking monomers as those used for copolymerisation with the marking monomers.

The process of identification is carried out by mechanically breaking down a specified quantity of the manufactured article, preferably a definite quantity of textile web which has been equipped with a marking polymer. This specimen is treated with alkaline liquors such as sodium hydroxide solution or with dilute mineral acid such as hydrochloric acid at temperatures of 100° to 120°C for 3 to 6 hours, optionally with stirring, so that diazotisable amines or amines or phenols which are capable of being coupled with diazonium salts are formed from the marking polymers by hydrolysis. Analysis of the colour forming component obtained by this process of degradation may be carried out by various methods, for example by 1. Applying a small volume of the resulting solution of diazotisable amine to filter paper, diazotising this test patch on the filter paper in an atmosphere of nitrous gases and spraying it with a solution of one of the coupling components indicated above, if necessary after first buffering the residual mineral acid or alkali liquor.

The color shade of the resulting characteristic dye may then be compared visually with those of test dyes which are prepared by the method indicated from the aromatic or heterocyclic amines described above which act as color forming components and the coupling components mentioned as examples below.

2. Chromatographing the solution of diazotisable amine which has been acidified with mineral acid and optionally filtered, using thin layer plates with flow agents which act as separators, drying the chromatograms, diazotising in an atmosphere of nitrous gases and then spraying with a solution of one of the coupling components indicated. The resulting characteristic dye is identified by determination of the $R_f$ value and/or comparison with a standard chromatogram of test dyes which are prepared in the same manner on the same thin layer plate. The test dyes are also suitable for quantitative determination of the marking monomer if the comparison described above is carried out visually or by measuring techniques, for example with a standardised series of cocncentrations. The Rf values are chromatographic characteristics which define the position of the substance in the chromatogram and are defined as $$R_f = \frac{\text{length of flow path of substance}}{\text{length of flow path of fluid agent}}$$

(see I. M. Hais and K. Macek, *Handbuch der Papierchromatographie*, Vol.I, VEB Gustav Fischer Verlag, Jena, 1958).

3. Direct or indirect diazotisation of the solution of colour forming components, if indicated after filtration, and coupling with one of the given coupling components to produce the dye, a solution of the dye being then used directly for thin layer chromatographic analysis. Identification is carried out as described under (2) by determination of the $R_f$ value and/or comparison with a standard chromatogram of test dyes which, as already indicated, may also be used for quantitative determination.

The following are examples of suitable coupling components

1. N-naphthyl-1-ethylene diamine
2. N,N-dihydroxyethylaniline,
3. N,N-dihydroxyethyl-n-toluidine,
4. N,N-dihydroxyethylamino-p-anisidine.

4. Placing drops of a small volume of the solution of the resulting amine or phenol which is capable of coupling on filter paper, if necessary buffering the test areas with sodium acetate solution, and then coupling by placing drops of diazonium salt solution on the areas.

The color shade of the resulting characteristic dye may then be compared visually with those of test dyes which have been prepared from the aromatic amines or phenols described above which act as colour forming components and one of the diazonium salts mentioned below.

The following are examples of suitable diazonium compounds:

a. Fast red salt ITR
b. Fast scarlet salt GG
c. Fast blue salt B d. Diazotised sulphanilic acid = Paulys reagent.

Literature reference to (a) to (c):

I. Perkavec et al. *Mikrochim. Acta* 1964, page 1029.

Literature reference to (d):

E. Stahl, *Dunnschicht-Chromatographie*, Springer, 1967, page 851; H. Jatskewitz, Hoppe-Seylers, *Z. physiol. Chem.* 292, page 99 (1953); M. R. Grimmett et al. *J. Chromatogr.* 20, page 171 (1965).

5. Chromatographing the solution of the resulting amine or phenol which is capable of coupling, if necessary after filtration, on thin layer plates using fluid agents which act as separating agents, drying the chromatograms and then spraying with a solution of one of the diazonium salts mentioned above, in particular with Paulys reagent. The characteristic dye formed is identified by determination of the $R_f$ value and/or comparison with a standard chromatogram of test dyes which are prepared by the same method on the same thin layer plate.

A. PREPARATION OF THE MARKING MONOMER

3-methacryloylaminochlorobenzene used as starting material

101 G (1 mol) of triethylamine are added to 127.6 g (1 mol) of 3-chloroaniline in 800 cc of acetonitrile. 104.5 g (1 mol) of methacryloyl chloride are added dropwise at −2° to −5°C with stirring and when the reaction has died down stirring is continued for 1 hour at 20°C (room temperature).

160 G of slightly yellowish crystals of 3-methacryloylamino-chlorobenzene of the formula

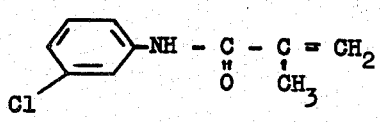

are obtained. The analytical values obtained for C, H, N and Cl correspond with the theoretical values within the limits of error. 3-Methacryloylamino-chlorobenzene is practically insoluble in water but readily soluble in acetone. No conversion to the diazonium salt takes place with sodium nitrite in aqueous acid suspension at pH 1 to 2.

Preparation of marking monomers used as starting materials from other carboxylic or sulphonic acid chlorides with other amines or with phenols is carried out by analogous methods which may be modified in that higher reaction temperatures or other diluents may be employed. The same applies to the reaction with carboxylic acid anhydrides such as maleic acid anhydride which is advantageously used as a solution in chloroform.

B. PREPARATION OF A MARKING POLYMER

To effect polymerisation, 1100 parts by weight of deionised water, 20 parts by weight of a reaction product of oleyl alcohol and ethylene oxide (molar ratio approximately 1 : 19), 3 parts by weight of lauryl sulphate, 40 parts by weight of 3-methacryloylaminochlorobenzene 200 parts by weight of methyl acrylate and 70 parts by weight of butyl acrylate are converted into an emulsion in a polymerisation vessel equipped with stirrer with the exclusion of atmospheric oxygen. The temperature is adjusted to 25°C and 0.5 parts by weight of ammonium persulphate and 0.6 parts by weight of sodium pyrosulphite are introduced into the stirred emulsion of monomers.

Where more than 75 % of the monomers have polymerised, 10 parts by weight of the reaction product of ethylene oxide and oleyl alcohol are added, followed by 50 parts by weight of 3-methacryloylamino-chlorobenzene together with 200 parts by weight of methyl acrylate, 70 parts by weight of butyl acrylate and 1.5 parts by weight of lauryl sulphate.

Polymerisation is completed by adding 0.5 parts by weight of ammonium persulphate and 0.6 parts by weight of sodium pyrosulphite to the polymerisation mixture and heating to 70°C for 3 hours. The degree of polymerisation is then determined by measuring the solids content and found to be 94 to 95 %. The residual monomers are removed by degasification under vacuum. A film-forming latex which has a solids content of 39 % is obtained. The copolymer has a mainly statistical structure and consists of copolymerised units of 15 % by weight of 3-methacryloylaminochlorobenzene and 85 % by weight of methyl acrylate and butyl acrylate. Molecular weight approximately 110,000 determined osmometrically in dimethylformamide.

EXAMPLE 1

1.1. A stable fibre fleece produced from a mixture of cotton and polyamide fibres in the proportion of 4 : 1 by weight is impregnated by spraying with the copolymer dispersion specified above which has been diluted to 24 %. The fleece is squeezed off to reduce the liquid uptake to 100 %, based on the weight of the fibres, and is then dried at about 80°C and condensed for 10 minutes at 130°C.

1.2. Qualitative identification (drop analysis)

1 G of the impregnated fleece is cut up into pieces measuring about 0.5 $cm^2$ and then boiled under reflux with 50 cc of 6N hydrochloric acid for 6 hours. The solution, which contains 3-chloroaniline-chloride formed by hydrolysis, is then cooled to room temperature. A few drops of this solution are placed on a filter paper. After drying (approximately 30 seconds at 60°C), the filter paper is exposed to moist nitrous gases (containing approximately 1 volume % of $N_2O_4$) at room temperature for 5 minutes to diazotise the amine component in the drops. Coupling to form the dye is carried out by spraying the diazotised drops with a 1 % solution of N-naphthyl-1-ethylenediamine hydrochlorie in a mixture of 20 volumes % of water and 80 volumes % of methanol. The original drops become deep blue-red in color. A drop of solution of the test dye may be placed beside the test areas for a visual comparison of the characteristic blue-red colour shade obtained. A solution of test dye may be prepared in the usual manner from 3-chloroaniline by diazotisation and coupling with N-naphthyl-(1)-ethylene-diamino hydrochloride and may then be diluted until the colour is comparable in depth to that of the test area.

EXAMPLE 2

2.1. An approximately 35 % aqueous dispersion of a statistical copolymer of 58% of butyl acrylate, 30 % of styrene, 5 % of methacrylic acid amide, 3 % of methacrylic acid and 4 % of 3-methacryloylaminochlorobenzene is prepared by method B. Molecular weight of the copolymer approximately 90,000 determined osmometrically in dimethylformamide.

A staple fibre fleece weighing approximately 30 g/m² and consisting of a mixture of regenerated cellulose fibres and polyester fibres (polyethylene glycol terephthalate) in proportions by weight of 9 : 1 is impregnated by spraying with the copolymeer dispersion specified above which has been diluted to 24 %. The fleece is squeezed off to reduce the liquid uptake to 100 %, based on the weight of fibres, and is then dried at about 80°C and condensed at 130°for about 10 minutes.

2.2. Qualitative identification (drop analysis)

Preparation of a sample and qualitative analysis are carried out as described under 1.2. The characteristic blue-red color shade obtained in the test areas may be compared visually in the same way with a solution of test dye which may be prepared as described in 1.2.

2.3. Qualitative chromatographic identification

2 μl of the hydrolysed solution described above and, for the standard chromatogram (E. Stahl, *Dunnschichtchromatographie*, Springer, 1967, page 145), 2 μl of a solution of 3-chloroaniline in hydrochloric acid at a comparable concentration are applied to a commercial silica gel plate. After drying the starting areas with air at about 60°C for 30 seconds, the plate is placed into a suitable glass vessel which can be sealed and into which the following fluid agent had been introduced 1 hour earlier: 9 Parts of benzene, 1 part of methanol (parts of volume). The height to which the vessel is filled with this liquid should be about 0.5 cm below the level of the starting areas on the plate.

The vessel should be shielded against direct light during the chromatographic process.

The plate is removed from the vessel after one hour and dried with air at about 60°C for 2 minutes. Diazotisation is carried out by exposing the plate inside a suitable glass vessel to the action of moist nitrous gases (consisting of approximately 1 % by volume of $N_2O_4$) for 5 minutes at room temperature. The plate is then removed from the vessel, placed almost vertically and left in air for 2 to 3 minutes, during which time excess nitrous gases escape from the silica gel layer of the plate, and then sprayed with the solution of N-naphthyl-1-ethylene diamine hydrochloride described above. The patches of 3-chloroaniline turn a deep blue red. The $R_f$ value if 0.8.

2.4. Quantitative determination of the 3-methylacryloylaminochlorobenzene content in the given staple fibre fleece. 2.4.1 Quantitative determination is based on the given calibration curve which is explained below:

10 mg of 3-methacryloylamino-chlorobenzene which has been prepared by method A are hydrolysed with 5 ml of 6 N hydrochloric acid for 20 hours in a test tube which has been sealed at both ends. The solution containing the resulting 3-chloroaniline hydrochloride is cooled to about 4°C and the tube is opened. The solution is then diazotised by the addition of approximately 1.5 ml of saturated sodium nitrite solution which has previously been adjusted to a temperature of about 4°C. The reaction mixture is then left to stand for about 10 minutes and the excess of nitrite removed by the addition of a 10 % aqueous solution of amidosulphonic acid. Complete removal is checked as usual with an iodine/potassium iodide starch paper. The contents of the test tube are then transferred quantitatively into a wide necked 250 ml Erlenmeyer flask and 2 ml of isopropanol and 150 ml of distilled water are added and the reaction mixture is coupled by the addition of 20 ml of a 0.1 % solution of N-naphthyl-1-ethylenediamine hydrocloride dissolved in a 1:1 mixture (parts by volume) of distilled water and methanol.

The resulting solution of blue-red dye is then heated to 70°C for 10 minutes, cooled and quantitatively transferred into a measuring flask and made up to 200 ml with distilled water.

After shaking the contents and then leaving the flask to stand for a short time for removal of air, extinction measurements may be carried out. Result at 420 nm in 2 cm cup: $\epsilon$=0.758.

The dye solutions obtained by the method described above from 7.5, 5 and 2.5 mg of 3methacryloyl-aminochlorobenzene and approximately reduced quantities of sodium nitrite and N-naphthyl-1-ethylenediamine hydrochloride have the following values when measured under similar conditions:

Weight 7.5 mg : $\epsilon$=0.570
Weight 5.0 mg : $\epsilon$=0.384
Weight 2.5 mg : $\epsilon$=0.170

The extinction values obtained can be plotted in the calibration curve below against the quantity in mg of 3-methacryloyl-aminochlorobenzene.

2.4.2. The quantity of 3-methacryloylaminochlorobenzene in the fleece specified under 2.1 may be determined as follows: 1 ± 0.050 g of fleece which has been conditioned to 65 % relative humidity at 20°C for 20 hours are hydrolysed with 5 ml of 6N hydrochloric acid in a sealed test tube for 20 hours and diazotised as described under 2.4.1. The prepared diazonium solution is filtered through a medium hard filter paper and transferred quantitatively into a wide necked 250 ml Erlenmeyer flask with the aid of dilute hydrochloric acid. The dye solution is then prepared as described under 2.4.1 and the extinction is determined in a 2 cm cup at 420 nm. The quantity of 3-methyacryloylaminochlorobenzene in the fleece can be read off the calibration curve from the $\epsilon$-value obtained and converted into the percentage content in the usual manner.

EXAMPLE 3

A paste consisting of 28 % of a completely saponified ethylene/vinyl acetate copolymer which before saponification contained vinyl acetate and ethylene in a molar ratio of 1:5.8 and which has been reduced to a particle size of less than 80 μ, 61 parts by weight of water, 2 parts by weight of glycerol, 2 parts by weight of diethylene glycol and 2 parts by weight of ammonium polyacrylate as well as 5 parts by weight of a polymer dispersion consisting of 77% of methyl acrylate, 15.6 % of acrylonitrile and 7.4 % of methacrylic acid-2,4-dichloroanilide (the copolymer was prepared by the general method described for polymer B and the methacrylic acid-2,4-dichloroanilide was prepared according to method A) having a solids concentration of 40 % is applied to interlining fabric by a rotation screen printing process. The pattern obtained is punctate at regular intervals. An interlining which can be heat sealed is thereby obtained.

QUALITATIVE IDENTIFICATION

1 G of the resulting interlining is cut up into pieces of about 0.5 cm² and then hydrolysed with 5 ml of normal sodium hydroxide solution in a sealed test tube at 110°C for 16 hours. The solution of the resulting 2,4-dichloroaniline is th cooled, the test tube is opened, the pH is adjusted to 1 – 2 by the addition of dilute hydrochloric acid and the reaction product is then diazotised in drops as described in Example 2 and coupled with N-naphthyl-1-ethylene diamine.

For visual comparison of the resulting characteristic red violet dye, a solution of test dye may be prepared in the usual manner from 2,4-dichloroaniline and N-naphthyl-1-ethylenediamine hydrochloride.

QUALITATIVE CHROMATOGRAPHIC IDENTIFICATION

The hydrolysed solution of 2,4-dichloroaniline adjusted to pH 1–2 is chromatographed by the chromatographic technique described in Example 2 and rendered visible on the plate. The $R_f$ value obtained is 0.9.

EXAMPLE 4

A 40 % aqueous dispersion of a statistical copolymer of 58 % of butyl acrylate, 30 % of styrene, 5 % of methacrylic acid amide, 3 % of methacrylic acid and 4 % of the phenyl ester of 3-methacrylic acid is prepared by method B.

A staple fibre fleece weighing about 30 g/m² and consisting of a mixture of regenerated cellulose and polyester fibres (polyterephthalate) in proportions by weight of 9:1 is impregnated by spraying with the copolymer dispersion specified above which has been diluted to 24 %. The fleece is squeezed off to reduce the liquid uptake to 100 %, based on the weight of fibers, dried at about 80°C and then condensed at 130°C for about 10 minutes.

QUALITATIVE IDENTIFICATION (DROP ANALYSIS)

1 G of the staple fibre fleece described above is cut up into pieces of about 0.5 cm² and then hydrolysed by the addition of 5 ml of 6N hydrochloric acid and heating in the sealed test tube for 20 hours at 110°C. The reaction solution, which contains the phenol formed by hydrolysis, is then cooled to room temperature. After the test tube has been opened, a few drops of this liquid are placed on a filter paper and dried with air at 60°C for 30 seconds. A few drops of dilute sodium hydroxide solution and a solution of diazotised sulphanilic acid (Paulys reagent) are then placed successively on these patches. The test patches become intensively yellow in colour. For visual comparison of the resulting yellow dye, drops of a solution of test dye may be placed beside the test patches and dried as described above. This solution of test dye may be prepared from phenol and Paulys reagent by the method known from the literature.

QUALITATIVE CHROMATOGRAPHIC IDENTIFICATION

2 μl of the hydrolysed solution specified above and 2 μl of an aqueous solution of phenol of comparable concentration required for the standard chromatogram are applied to a commercial silica gel plate and dried with air at about 60 C for 30 seconds. The plate is placed inside a suitable glass vessel into which the following fluid agent had been introduced one hour earlier: 2 Parts of methyl ethyl ketone, 8 parts of ethylene chloride (in parts by volume). The height to which the vessel is filled with this fluid should be about 0.5 cm below the level of the starting points on the plate. The vessel should be shielded against direct light during the chromatographic process.

The plate is removed from the vessel 1 hour later, dried with air at about 60°C for 2 minutes and then sprayed with a solution of diazotised sulphanilic acid (Paulys reagent). The chromatographic patches are thereby turned deep yellow. The $R_f$ value is 0.8.

We claim:

1. A process for marking a manufactured article with identification which comprises applying a marking agent to said manufactured article, said marking agent being a high molecular weight compound containing at least one group which can be removed by a cleaving reaction to form a low molecular weight compound, said low molecular weight compound being a diazotizable amine or an amine or phenol which can be coupled with a diazonium salt and thus converted into a dye.

2. The process of claim 1 wherein said marking agent is a homopolymer or copolymer of a polymerizable ethylenically unsaturated compound containing said at least one group.

3. The process of claim 1 wherein said marking agent is applied to a manufactured textile article in admixture with a polymer which is suitable for textile finishing.

4. The process of claim 1 wherein the marking agent is a homopolymer or a copolymer of a monomer of the formula

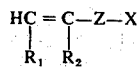

wherein $R_1$ is hydrogen, methyl or

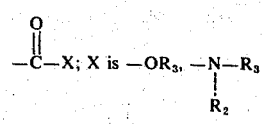

or a group which may be converted by hydrolysis into a diazotizable amine or into an amine or phenol which may be coupled with a diazonium salt; $R_2$ is hydrogen or alkyl having 1 to 12 carbon atoms; $R_3$ is an aromatic group which may be interrupted by heteroatoms or by heteroatomic groups, one of said groups substituted by alkyl having 1 to 4 carbon atoms, alkoxy having 1 to 4 carbon atoms or halogen, or a heterocyclic group which may form part of an azo compound after diazotization and coupling or after coupling alone; and Z is

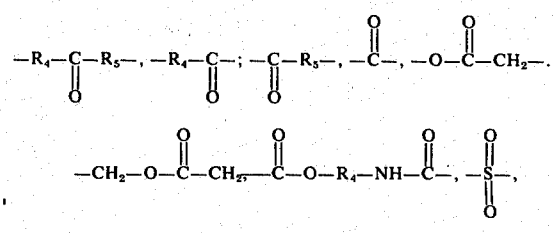

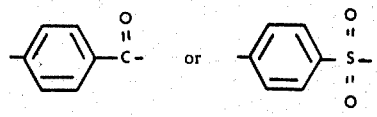

wherein $R_4$ and $R_5$ are alkylene having 1 to 4 carbon carbon atoms with the proviso that at least one X is said group convertible by hydrolysis and the further proviso that when Z is

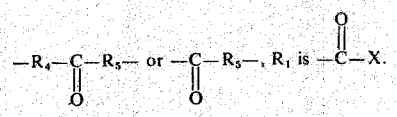

5. The process of claim 1 wherein said marking agent is a copolymer of 0.05 to 20% by weight of a monomer of the formula

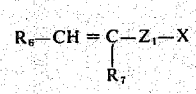

and 99.95 to 80% by weight of at least one other ethylenically unsaturated monomer, $R_6$ being hydrogen or -COOH; $R_7$ being hydrogen or methyl; $Z_1$ being

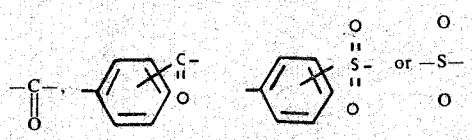

and X is a group which may be converted by hydrolysis into a diazotizable amine or into an amine or phenol which can be coupled with a diazonium salt.

6. The process of claim 5 wherein an aqueous dispersion of said copolymer having a solids content of 20 to 50% by weight is used as the marking agent.

7. The process of claim 5 wherein the other ethylenically unsaturated monomer is at least one member of the group consisting of styrene, butadiene, acrylic acid ester, methacrylic acid ester, vinyl acetate, acrylic acid, methacrylic acid, acrylamide and methacrylamide.

8. The process of claim 5 wherein said monomer of said formula is selected from the group consisting of methacrylic acid anilide, acrylic acid anilide, maleic acid half anilide, 3-acryloyl-aminobenzenesulphonamide, 3-methacryloylaminobenzenesulphonamide, 2-maleinyl-aminobenzenesulphonamide, 4-acryloyl-aminobenzenesulphonamide, 4-methacryloyl-benzenesulphonic acid amide, 4-maleinyl-benzenesulphonic acid amide, 3-acryloylaminotoluene, 3-methacryloyl-aminotoluene, the corresponding maleic acid half amide, fumaric acid, derivatives of fumaric acid, acrylic acid-2,5-dichlorophenylamide, methacrylic acid-2,5-dichlorophenylamide, the corresponding maleic acid half amide, acrylic acid-3-chlorophenylamide, methacrylic acid-3-chlorophenylamide, acrylic acid-4-ethylsulphonylphenylamide, methacrylic acid-4-ethylsulphonylphenylamide, acrylic acid-3-methoxyphenylamide, methacrylic acid-3-methoxyphenylamide, 3-acryloylaminobenzimidazole, 3-methacryloylaminobenzimidazole and 3-methacryloylaminobenzenesulphonic acid-1-benzenesulphonylamide.

9. The manufactured article marked with identification as produced by the process of claim 1.

* * * * *